US007569983B2

(12) United States Patent
Kim et al.

(10) Patent No.: US 7,569,983 B2
(45) Date of Patent: Aug. 4, 2009

(54) FLAT FLUORESCENT LAMP AND LIQUID CRYSTAL DISPLAY USING THE SAME

(75) Inventors: Byung-Soo Kim, Seoul (KR); Yong-Sang Cho, Seoul (KR); Hyo-Young Lee, Gyeonggi-do (KR); Eun-Gon Lee, Daegu (KR)

(73) Assignee: LG Micron Ltd., Gyeongsang buk-do (KR)

( * ) Notice: Subject to any disclaimer, the term of this patent is extended or adjusted under 35 U.S.C. 154(b) by 317 days.

(21) Appl. No.: 11/669,108

(22) Filed: Jan. 30, 2007

(65) Prior Publication Data

US 2007/0188099 A1 Aug. 16, 2007

(51) Int. Cl.
*H01J 1/62* (2006.01)

(52) U.S. Cl. ..... 313/493; 313/634

(58) Field of Classification Search ..... 313/483, 313/493, 634

See application file for complete search history.

(56) References Cited

U.S. PATENT DOCUMENTS 4,703,219 A * 10/1987 Mesquida ..... 313/111

* cited by examiner

*Primary Examiner*—Vip Patel
(74) *Attorney, Agent, or Firm*—Lee, Hong, Degerman, Kang & Waimey

(57) ABSTRACT

Disclosed herein is a light source device. The light source device includes a front transparent substrate, a rear substrate, a plurality of partitions, and fluorescent material. The rear substrate is configured to face the front transparent substrate with a discharge space disposed therebetween. The partitions are arranged between the front transparent substrate and the rear substrate to divide the discharge space into a plurality of discharge channels. The fluorescent material is applied on the inside of the discharge space. Meanwhile, the partitions are formed such that the ratio of the radius of curvature R of each partition to the width W of the partition, that is, R/W, ranges from 0.1 to 4.

9 Claims, 4 Drawing Sheets

FLAT FLUORESCENT LAMP AND LIQUID CRYSTAL DISPLAY USING THE SAME

The present disclosure relates to subject matter contained in priority Korean Application No. 10-2005-0070077, filed on Jul. 30, 2005, which are herein expressly incorporated by reference in their entirety.

BACKGROUND OF THE INVENTION

1. Field of the Invention

The present invention relates generally to a Flat Fluorescent Lamp (FFL), and, more particularly, to an FFL that ensures a sufficient light emission area, thereby improving the uniformity of light emission and a luminance characteristic. Furthermore, the present invention relates to a Liquid Crystal Display (LCD) using the FFL.

2. Description of the Related Art

Cold-Cathode Fluorescent Lamps (CCFLS) are mainly used as lamps for various illumination devices or displays. Such CCFLs are classified into Internal Electrode Fluorescent Lamps (IEFLS) and External Electrode Fluorescent Lamp (EEFLS) according to the location of the electrodes. In IEFLs, electrodes are installed inside sealed glass tubes containing discharge gas and gaseous mercury, and fluorescent material is applied to the inside surfaces of the glass tubes. In contrast, in EEFLs, electrodes are installed outside glass tubes, and fluorescent material is applied to the inside surfaces of the glass tubes.

When high-frequency Alternating Current (AC) signals are applied to the internal electrodes of an IEFL, an electric field is generated between the electrodes, therefore plasma discharge occurs. Electrons, which are generated during the discharge, excite mercury, and ultraviolet rays are generated. Fluorescent material is excited and undergoes a transition due to the ultraviolet rays, thus resulting in the generation of visible rays.

In contrast, when high-frequency AC signals are applied to the external electrodes of an EEFL, plasma discharges are generated between positive electrodes inside a glass tube, electrons are generated, mercury is excited by the electrons, and finally fluorescent material emits light. The EFFL has advantages in that the amount of heat is low and the EFFL can be driven at high efficiency because wall charges are formed on the inside surface of a glass tube near the electrodes due to plasma discharge and subsequent plasma discharge is generated at relatively low voltage using the wall charges, and a plurality of EFFLs can be driven using a single inverter because the voltage drop is very small.

Meanwhile, an LCD displays images by adjusting the transmissivity of liquid crystal cells in response to video signals. An active matrix LCD has an advantage in its ability to display moving images because individual switching elements are formed for respective liquid crystal cells. Thin Film Transistors (hereinafter referred to as "TFTs") are chiefly used as the switching elements.

An LDC is not a self-emissive device, therefore it requires a separate backlight unit. Conventional backlight units for LCDs are classified into edge light-type backlight units, each of which converts light, radiated from a lamp located at one end thereof, into surface light using a light guide plate, and radiates the surface light onto an LCD panel, and direct light-type backlight units, each of which radiates light onto an LCD panel using a plurality of lamps located under the LCD panel.

Recently, research and development into light source devices, which have light emission efficiency, luminance, and uniformity of luminance greater than those of existing edge light type backlight units or existing direct light type backlight units, is being actively conducted.

FIG. 1 is a diagram showing the schematic structure of a conventional light source device. Referring to FIG. 1, the light source device includes a front transparent substrate 1 and a rear substrate 1, partitions 4 configured to form plasma discharge channels 8 between the front transparent substrate 1 and the rear substrate 2, fluorescent material 5 applied to the insides of the plasma discharge channels 8, and electrodes 3*a* and 3*b* formed on the outside surfaces of the rear substrate 2 and configured to have opposite polarities. An insulating layer 7 is further provided on the electrode 3*a* formed on top of the rear substrate 2, and electrically insulates the electrode 3*a*.

The electrodes 3*a* and 3*b* may be formed in the sides of the plasma discharge channels 18 so that they are opposite each other.

Inert gases, that is, argon (Ar), neon (Ne) and xenon (Xe), along with gaseous mercury (Hg), are uniformly injected into the plasma discharge channels 8.

The partitions 4 have a height ranging from several mm to tens of mm, and functions to form plasma discharge channels 8 between the front transparent substrate 1 and the rear substrate 12. Furthermore, both side surfaces of each partition 14 are formed to have slopes, or are curved to have curvature, therefore light is reflected therefrom, thereby increasing the light emission area.

The fluorescent material 5 functions to emit light by mercury excited by electrons generated by plasma discharges, and to radiate visible rays.

AC voltage is applied to the electrodes 3*a* and 3*b* so that electric discharge occurs in the plasma discharge channels 8.

A glass frame 9 is disposed between the front transparent substrate 1 and the rear substrate 2 along the edge of the light source device, and the glass frame 9 is attached to the front transparent substrate 1 and the rear substrate 2 using a sealant.

FIG. 2 is an enlarged view of a conventional partition, shown in region A of FIG. 1. Meanwhile, in FIG. 2, the illustration of the fluorescent material 5 is omitted for ease of understanding of a light path.

Referring to FIG. 2, since the top surface of the conventional partition 4 is formed to have no curvature, a dark region D is created. As a result, there is a problem in that uniform light emission and luminance cannot be achieved throughout the entire surface of an light source device.

SUMMARY OF THE INVENTION

Accordingly, the present invention has been made keeping in mind the above problems occurring in the prior art, and an object of the present invention is to provide an light source device that ensures a sufficient light emission area, thereby improving the uniformity of light emission and a luminance characteristic.

Another object of the present invention is to provide an LCD that uses the light source device as a backlight.

In order to accomplish the above object, the present invention provides an light source device, including a front transparent substrate; a rear substrate configured to face the front transparent substrate with a discharge space disposed therebetween; a plurality of partitions arranged between the front transparent substrate and the rear substrate to divide the discharge space into a plurality of discharge channels; and fluorescent material applied on the inside of the discharge space; wherein the partitions are formed such that the ratio of the radius of curvature R of each partition to the width W of the partition, that is, R/W, ranges from 0.1 to 4.

Preferably, R/W ranges from 0.13 to 2.83.

Additionally, the present invention provides an light source device, including a front transparent substrate; a rear substrate configured to face the front transparent substrate with a discharge space disposed therebetween; a plurality of partitions arranged between the front transparent substrate and the rear substrate to divide the discharge space into a plurality of discharge channels; and fluorescent material applied on the inside of the discharge space; wherein the partitions are formed such that the radius of curvature R of the upper portion of each partition ranges from 0.15 to 6 mm.

Preferably, the radius of curvature R of the upper portion of each partition ranges from 0.2 to 4.25 mm.

Additionally, the present invention provides an light source device, including a rear substrate; a front transparent substrate configured to face the rear substrate, with a discharge space disposed therebetween, and roundly corrugated such that the front transparent substrate is attached to the rear substrate at at least one portion, thereby dividing the discharge space into a plurality of discharge channels; and fluorescent material applied on an inside of the discharge space; wherein the ratio of the radius of curvature R of the portions of the front transparent substrate, which are attached to the rear portion, to the width W of portions of the front transparent substrate that constitute partitions through the attachment of the front transparent substrate to the rear substrate, that is, R/W, ranges from 0.15 to 4.25.

Preferably, R/W ranges from 0.15 to 2.5.

Additionally, the present invention provides an light source device, including a rear substrate; a front transparent substrate configured to face the rear substrate with a discharge space disposed therebetween, and roundly corrugated such that the front transparent substrate is attached to the rear substrate at at least one portion, thereby dividing the discharge space into a plurality of discharge channels; and fluorescent material applied on an inside of the discharge space; wherein the radius of curvature R of the portions of the front transparent substrate that are attached to the rear portion ranges from 0.15 to 4.25 mm.

Preferably, the radius of curvature R of the portions of the front transparent substrate that are attached to the rear substrate ranges from 0.15 to 2.5.

The front transparent substrate is made of glass material, and the rear substrate is made of metallic or ceramic material.

Additionally, the present invention provides an LCD device, including the light source device set forth in any one of claims 1 to 8; and an LCD panel configured to display images by modulating light from the light source device in such a way as to electrically control liquid crystals in response to video data.

BRIEF DESCRIPTION OF THE DRAWINGS

The above and other objects, features and advantages of the present invention will be more clearly understood from the following detailed description taken in conjunction with the accompanying drawings, in which.

DESCRIPTION OF THE PREFERRED EMBODIMENTS

Figure 1:
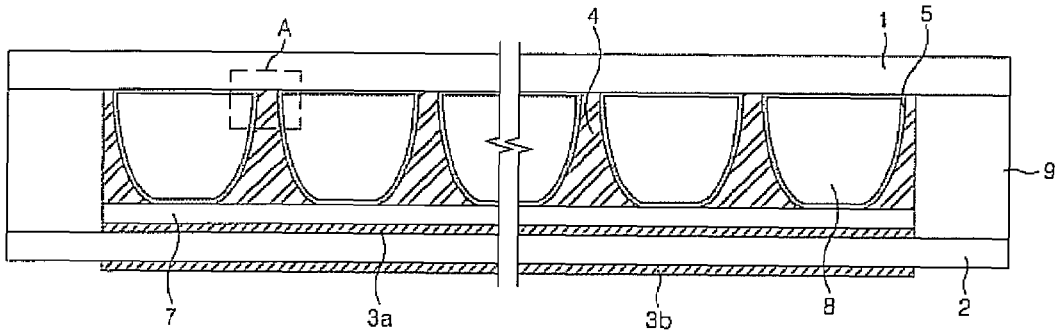
FIG. 1 is a diagram showing the schematic structure of a conventional light source device.

Reference now should be made to the drawings, in which the same reference numerals are used throughout the different drawings to designate the same or similar components.

With reference to FIGS. 3 to 5E, a preferred embodiment of the present invention will be described below.

Figure 3:
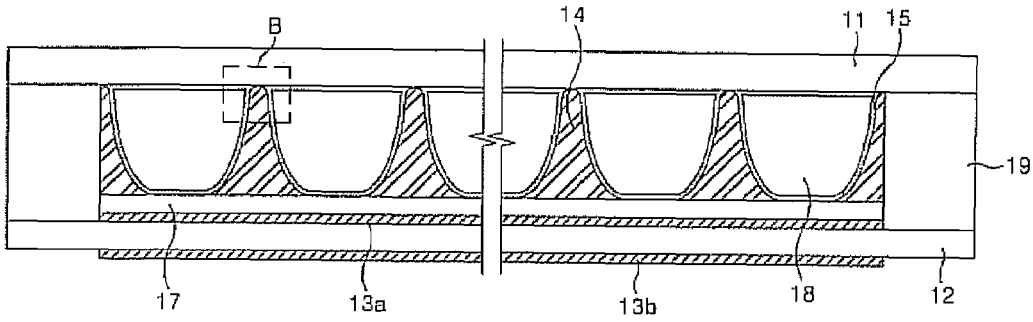
FIG. 3 is a diagram showing the schematic structure of an light source device according to an embodiment of the present invention.

Referring to FIG. 3, an light source device according to the embodiment of the present invention includes a front transparent substrate 11 and a rear substrate 12, partitions 14 configured to form plasma discharge channels 18 between the front transparent substrate 11 and the rear substrate 12, fluorescent material 15 applied to the insides of the plasma discharge channels 18, and electrodes 13*a* and 13*b* formed on the outside surfaces of the rear substrate 12 and configured to have opposite polarities. An insulating layer 17 is further provided on the electrode 13*a* formed on top of the rear substrate 12, and electrically insulates the electrode 13*a*.

The electrodes 13*a* and 13*b* may be formed in the sides of the plasma discharge channels 18 so that they are opposite each other.

Inert gases, that is, argon (Ar), neon (Ne) and xenon (Xe), and gaseous mercury (Hg) are uniformly injected into the plasma discharge channels 18.

The partitions 14 have a height ranging from several mm to tens of mm, and function to form plasma discharge channels 18 between the front transparent substrate 1 and the rear substrate 12. Furthermore, both side surfaces of each partition 14 are formed to have slopes, or are curved to have curvature, therefore light is reflected therefrom, thus increasing the light emission area. Moreover, the top of each partition 14 is formed to have a predetermined radius of curvature R. If both side surfaces of each partition 14 are not formed to have curvature or slopes and the overall partition 14 is formed in a hemispherical shape having only a predetermined radius of curvature, the area in which the partition 14 and the rear substrate 12 come into contact with each other is widened, therefore the light emission area of the light source device is reduced. As a result, each partition 14 according to the present invention is formed such that the top surface of the partition 14 has a certain radius of curvature R. Furthermore, both sides of each partition 14 are formed to have slopes or curvature, therefore the light emission area of an light source device can be sufficiently assured.

The fluorescent material 15 functions to emit light due to mercury that is excited by electrons generated during plasma discharge, and to radiate visible rays.

AC voltage is applied to the electrodes 13*a* and 13*b* so that electric discharge occurs in the plasma discharge channels 18.

A glass frame 19 is disposed between the front transparent substrate 11 and the rear substrate 12 along the edge of the light source device, and the glass frame 19 is attached to the front transparent substrate 11 and the rear substrate 12 using a sealant. The front transparent substrate 11 is made of glass material through which light can pass, and the rear substrate 12 is made of metallic or ceramic material.

Figure 4:
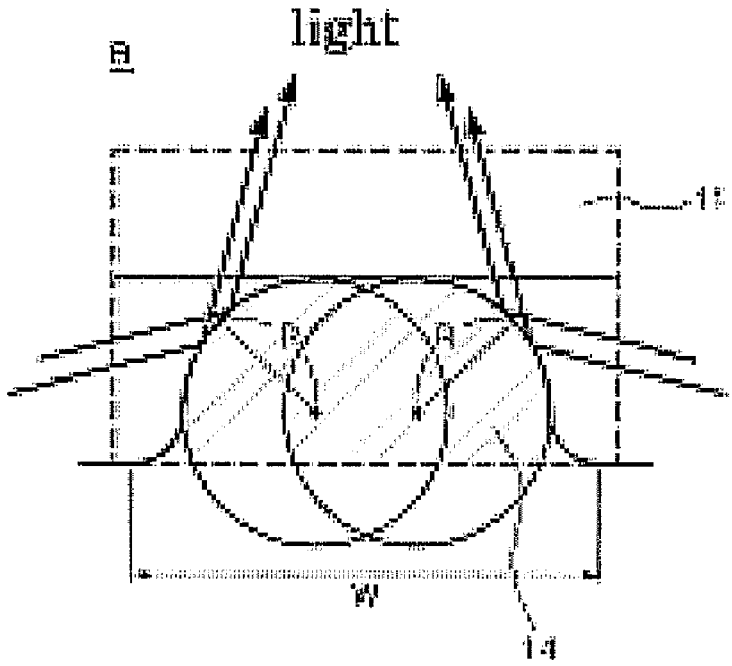
FIG. 4 is an enlarged diagram showing region B of FIG. 3.
Figure 5A:
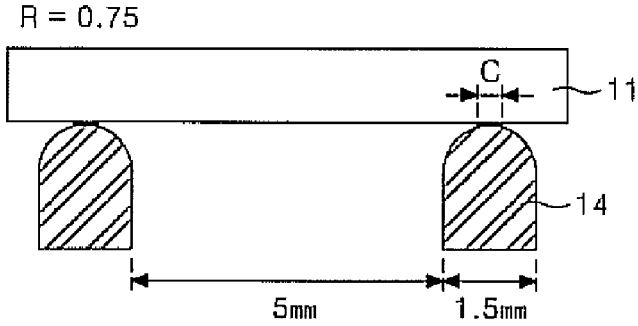
FIGS. 5A to 5E are diagrams showing the shapes of partitions that were used to measure luminance depending on the radius of curvature R.
Figure 5B:
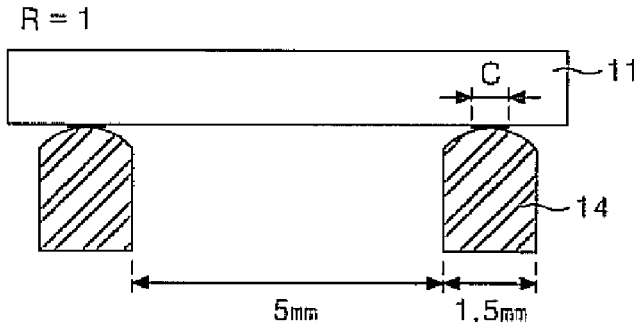
Figure 5C:
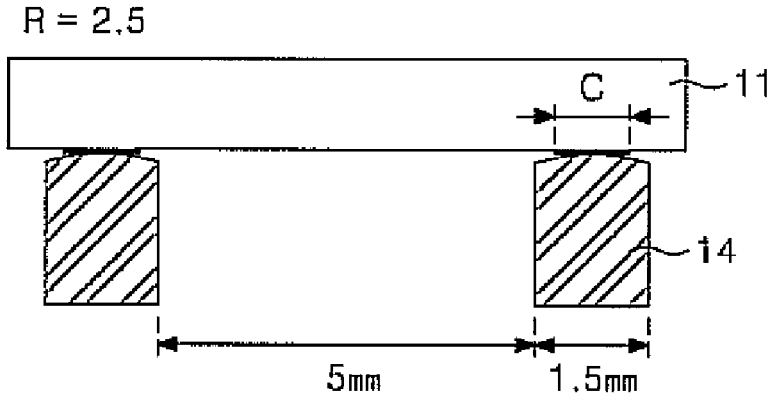
Figure 5D:
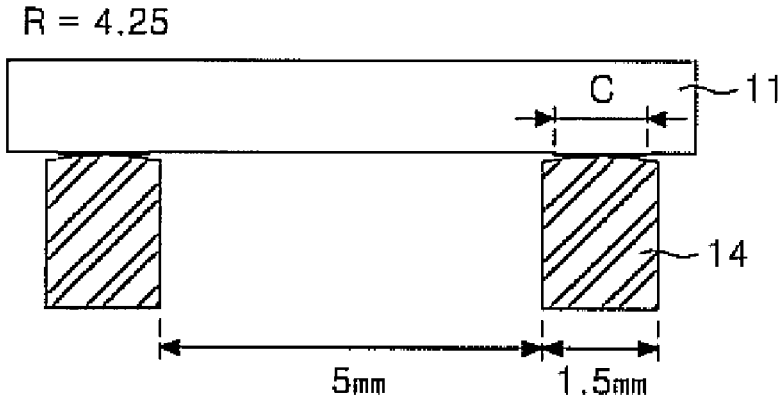
Figure 5E:
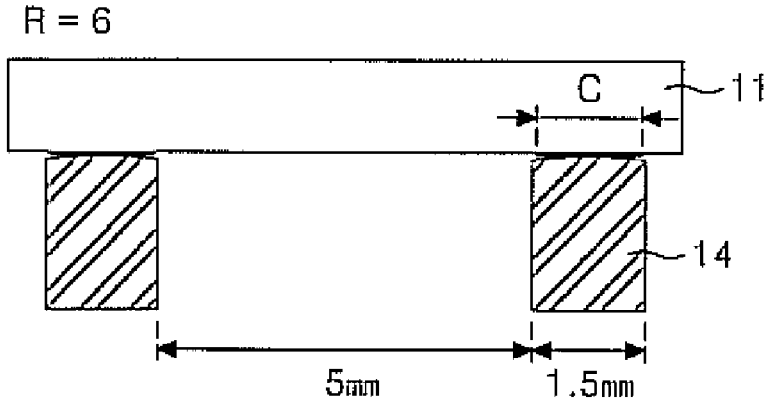

FIG. 4 is an enlarged view of the partition, shown in region B of FIG. 3, according to the present invention. Meanwhile, in FIG. 4, the illustration of the fluorescent material 15 is omitted for ease of understanding of a light path.

Figure 2:
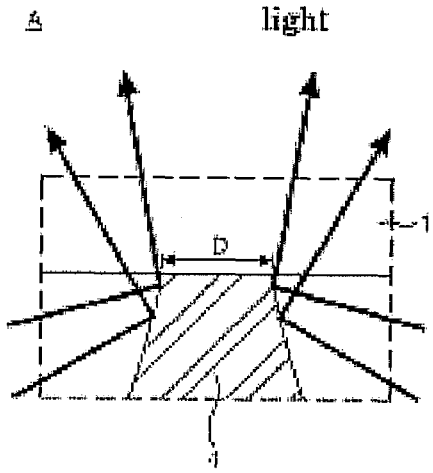
FIG. 2 is an enlarged diagram showing region A of FIG. 1.

Referring to FIG. 4, the partition 14 according to the present invention is formed such that the upper surface of the partition 14, where the front transparent substrate 11 comes into contact with the partition 14, is rounded with a predetermined radius of curvature R. A contact surface between the front transparent substrate 11 and the rounded partition 14 is formed to be narrower than that between the front transparent substrate 1 and the partition 4, which is shown in FIGS. 1 and 2. A light emission portion, which is defined by applying the fluorescent material 15 to the upper surface of the partition 14, is formed to be relatively wide. Light paths formed by the rounded partition 14 are made to extend toward a non-emissive region above the upper portion of the partition 14, therefore the amount of light of the non-emissive region is supplemented. As a result, the amount of light of an emissive region and the amount of light of a non-emissive region are made uniform.

FIGS. 5A to 5E are diagrams showing the shapes of partitions that were used at the time of measuring luminance for the radii of curvature R. Table 1 shows data that was obtained by measuring luminance for the radii of curvature R. In FIGS. 5A to 5E, value C indicates the width of the contact surface between the partition 14 and the front transparent substrate 11. The upper surface of the partition 14 and the front transparent substrate 11 come into contact through a sealant. Experimental data was analyzed on the assumption that a sealant C, through which the partition 14 and the front transparent substrate 11 came into contact, was a light absorbing body that absorbs 100% of light. Experiments were conducted with the width of each partition 14 fixed at 1.5 mm and the distance between partitions 14 fixed at 5 mm, and luminance was measured in front of an light source device. The fixed width of the partition 14 in the experiments is the width of the partition 14 between points of inflection.

Table 1 is a table that shows the luminance characteristic efficiency of the upper portion of each partition depending on the radius of curvature of the partition.

TABLE 1

| Radius of curvature of upper portions (R) | Width of partitions (W) | R/W | Relative front luminance measured based on R = 1 |
|---|---|---|---|
| 0.1 | 1.5 | 0.0667 | impossible to measure |
| 0.15 | 1.5 | 0.1 | 95 |
| 0.2 | 1.5 | 0.1333 | 99 |
| 0.5 | 1.5 | 0.3333 | 101 |
| 0.75 | 1.5 | 0.5 | 103 |
| 1 | 1.5 | 0.6667 | 100 |
| 1.5 | 1.5 | 1 | 93 |
| 2 | 1.5 | 1.3333 | 88 |
| 2.5 | 1.5 | 1.6667 | 86 |
| 4.25 | 1.5 | 2.8333 | 83 |
| 6 | 1.5 | 4 | 80 |
| 8 | 1.5 | 5.3333 | 72 |

Referring to table 1, when the width W of the partitions is 1.5 mm and the radius of curvature R of the upper portions of the partitions ranges from 0.15 to 6 mm, the luminance characteristic thereof is excellent. Meanwhile, when an light source device is manufactured using the radius of curvature, luminance, which can be achieved in regions where there are no partitions, can also be achieved in regions where there are partitions. Furthermore, when the radius of curvature R of the upper portion of the partition ranges from 0.2 to 4.25 mm, more closely similar luminance can be achieved.

That is, it can be seen that the luminance on the upper portions of the partitions is similar to the front luminance in the portions where there are no partitions when the ratio R/W of the radius of curvature R of the upper portions of the partitions to the width W of the partitions ranges from 0.1 to 4. Furthermore, it can be seen that the luminance in the upper portions of the partitions is very similar to or greater than that in the portions where there are no partitions. Moreover, when R/W ranges from 0.13 to 2.83, still more closely similar luminance can be achieved.

Meanwhile, it can be seen that luminance characteristic is lowered in the case where R/W exceeds 4.

Meanwhile, a vacuum is created in each plasma discharge channel 18 for electric discharge, therefore the partitions 14 must endure pressure generated at the time of creation of the vacuum. For this purpose, the area where the rear substrate 12 and each partition 14 come into contact is designed to be wider than the area where the front substrate 11 and the partition 14 come into contact.

By forming the upper portions of the partitions 14 to be round, as described above, the uniformity of luminance is improved because the amount of light passing through non-emissive regions and the amount of light passing through emissive regions are made uniform, and a luminance characteristic can be improved because a light emission area is formed to be wider.

In the meantime, the present invention can be applied not only to an light source device in which there are separate partitions, but also to an light source device in which there are no separate partitions and which is manufactured using a glass molding technique. That is, the present invention can be applied to a glass molded light source device in which a front rounded transparent substrate, formed by rounding a flat glass, is attached to a rear substrate. In this case, the front transparent substrate is attached to the rear substrate, and the portions of the front transparent substrate attached to the rear substrate function as the partitions. Here, the portions of the front transparent substrate attached to the rear substrate are not sharp, but are rounded, like the partitions according to the previous embodiment. When the ratio R/W of the radius of curvature R of the portions of the front transparent substrate that are attached to the rear substrate to the width W of a dark portion ranges from A to B, the luminance characteristic is excellent. When an light source device is manufactured using this radius of curvature, luminance, which is similar to that in regions where there are no dark portions, can be achieved in regions where there are dark portions.

Figure 6A:
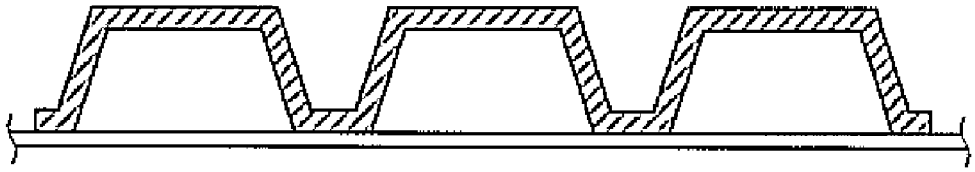
FIG. 6A shows the structure of a conventional glass molded light source device, in which a sharply corrugated front substrate is attached to a flat rear substrate.
Figure 6B:
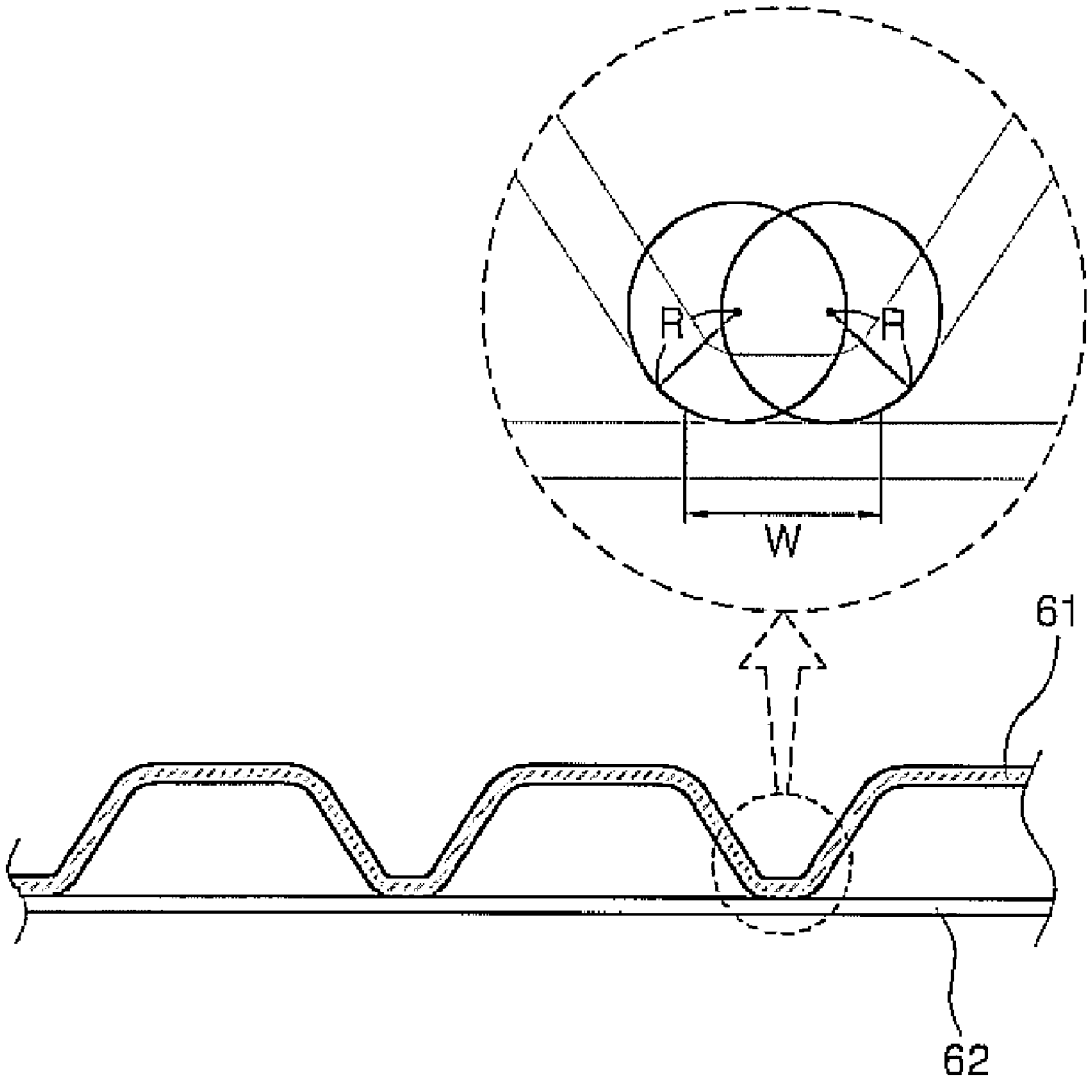
FIG. 6B shows the structure of a glass molded light source device in which a roundly corrugated front substrate is attached to a flat rear substrate according to the present invention.

FIG. 6A shows the structure of a conventional glass molded light source device, in which a sharply corrugated front substrate is attached to a flat rear substrate, and FIG. 6B shows the structure of a glass molded light source device in which a roundly corrugated front substrate is attached to a flat rear substrate according to the present invention.

Referring to FIG. 6B, the case where a front transparent substrate 61 is attached to a rear substrate 62 and the ratio R/W of the radius of curvature R of attached portions to the width W thereof ranges from A to B is illustrated. In this case, an amount of light that is similar to that radiated through the other regions can be radiated through the portions of the front transparent substrate 61 that are attached to the rear substrate 62.

Table 2 is a table that shows the luminance character efficiency of the attached portions of a front glass depending on the radius of curvature of the front glass in the case where glass molding is employed.

TABLE 2

| Radius of curvature of front substrate (R) | Width of dark portions (W) | R/W | Relative front luminance measured based on R = 1 |
|---|---|---|---|
| 0.1 | 1 | 0.1 | — |
| 0.15 | 1 | 0.15 | 100.4 |
| 0.2 | 1 | 0.2 | 100.4 |
| 0.5 | 1 | 0.5 | 100.8 |
| 0.75 | 1 | 0.75 | 100.4 |
| 1 | 1 | 1 | 100 |
| 1.25 | 1 | 1.25 | 99.6 |
| 1.5 | 1 | 1.5 | 97.6 |
| 2 | 1 | 2 | 95.2 |
| 2.5 | 1 | 2.5 | 92.8 |
| 4.25 | 1 | 4.25 | 85.6 |
| 6 | 1 | 6 | 78.8 |
| 8 | 1 | 8 | 72 |

Referring to table 2, when the width W of dark portions is 1 mm and the radius of curvature R of the front substrate ranges from 0.15 to 4.25 mm, the luminance characteristic is excellent. When an light source device is manufactured using the radius of curvature, the luminance, which is similar to that in the other portions, can be achieved in the portions of the front substrate that are attached to the rear substrate. Furthermore, when the radius of curvature R of the front substrate ranges from 0.15 to 2.5 mm, still more closely similar luminance can be achieved.

That is, it can be seen that, when the ratio R/W of the radius of curvature R of the attached portions of the front substrate to the width W of dark portions ranges from 0.15 to 4.25, the luminance at a location above the attached portions of the front substrate is similar to front luminance. It can be seen that, when R/W ranges from 0.15 to 2.5, the luminance in the attached portion of the front substrate is very similar to or greater than front luminance.

Meanwhile, it can be seen that when R/W exceeds 4.25, the luminance characteristic is reduced.

The EFL according to the present invention may be used as a light source for a non-emissive device, such as a general illumination device or an LCD. Meanwhile, the LCD panel for an LCD device according to the present invention may be implemented as any known LCD panel that modulates light from the light source device by electrically controlling liquid crystals in response to video data.

As described above, the light source device according to the present invention is manufactured such that the upper surfaces of the partitions are rounded at a predetermined radius of curvature, so that a sufficient light emission area is ensured, thereby improving the luminance characteristic. Furthermore, by adjusting the radius of curvature of the partitions, the straight travel of light and the uniformity of light emission can be improved.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A light source device, comprising:

a front transparent substrate;

a rear substrate configured to face the front transparent substrate with a discharge space disposed therebetween;

a plurality of partitions arranged between the front transparent substrate and the rear substrate to divide the discharge space into a plurality of discharge channels; and fluorescent material applied on an inside of the discharge space;

wherein the partitions are formed such that a ratio of a radius of curvature R of each partition to a width W of the partition, that is, R/W, ranges from 0.1 to 4.

2. The light source device as set forth in claim 1, wherein the R/W ranges from 0.13 to 2.83.

3. An light source device, comprising:

a front transparent substrate;

a rear substrate configured to face the front transparent substrate with a discharge space disposed therebetween;

a plurality of partitions arranged between the front transparent substrate and the rear substrate to divide the discharge space into a plurality of discharge channels; and fluorescent material applied on an inside of the discharge space;

wherein the partitions are formed such that a radius of curvature R of an upper portion of each partition ranges from 0.15 to 6 mm.

4. The light source device as set forth in claim 3, wherein the radius of curvature R of the upper portion of each partition ranges from 0.2 to 4.25 mm.

5. An light source device, comprising:

a rear substrate;

a front transparent substrate configured to face the rear substrate, with a discharge space disposed therebetween, and roundly corrugated such that the front transparent substrate is attached to the rear substrate at at least one portion, thereby dividing the discharge space into a plurality of discharge channels; and fluorescent material applied on an inside of the discharge space;

wherein a ratio of a radius of curvature R of the portions of the front transparent substrate, which are attached to the rear portion, to a width W of portions of the front transparent substrate that constitute partitions through the attachment of the front transparent substrate to the rear substrate, that is, R/W, ranges from 0.15 to 4.25.

6. The light source device as set forth in claim 5, wherein the R/W ranges from 0.15 to 2.5.

7. An light source device, comprising:

a rear substrate;

a front transparent substrate configured to face the rear substrate with a discharge space disposed therebetween, and roundly corrugated such that the front transparent substrate is attached to the rear substrate at at least one portion, thereby dividing the discharge space into a plurality of discharge channels; and fluorescent material applied on an inside of the discharge space;

wherein a radius of curvature R of the portions of the front transparent substrate that are attached to the rear portion ranges from 0.15 to 4.25 mm.

8. The light source device as set forth in claim 7, wherein the radius of curvature R of the portions of the front transparent substrate that are attached to the rear substrate ranges from 0.15 to 2.5.

9. The light source device as set forth in any one of claims 1 to 8, wherein the front transparent substrate is made of glass material, and the rear substrate is made of metallic or ceramic material.

* * * * *